US008161883B1

(12) United States Patent
Harasts et al.

(10) Patent No.: US 8,161,883 B1
(45) Date of Patent: Apr. 24, 2012

(54) FLASH-BANG GRENADE WITH GREATER FLASH INTENSITY

(75) Inventors: Nicole D. Harasts, Andover Township, NJ (US); William Chung-Leung Chow, Belleville, NJ (US); Mark Motyka, Fairfield, NJ (US); Steve Kotefski, Bloomingdale, NJ (US); Lidija Kotevska, Bloomingdale, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 98 days.

(21) Appl. No.: 12/837,697

(22) Filed: Jul. 16, 2010

Related U.S. Application Data

(60) Provisional application No. 61/226,033, filed on Jul. 16, 2009.

(51) Int. Cl.

| | |
|---|---|
| ***F42B 12/36*** | (2006.01) |
| ***F42B 8/12*** | (2006.01) |
| ***F42B 4/04*** | (2006.01) |
| ***F42B 27/00*** | (2006.01) |

(52) U.S. Cl. ..... 102/482; 102/498; 102/361

(58) Field of Classification Search ..... 102/482, 102/486, 487, 498, 335, 336, 361, 368
See application file for complete search history.

(56) References Cited

U.S. PATENT DOCUMENTS

| | | | | |
|---|---|---|---|---|
| 3,492,945 | A * | 2/1970 | Filippi | 102/498 |
| 4,932,328 | A * | 6/1990 | Pinkney et al. | 102/482 |
| 4,947,753 | A * | 8/1990 | Nixon, III | 102/487 |
| 4,976,201 | A * | 12/1990 | Hamilton | 102/323 |
| 5,085,147 | A * | 2/1992 | Gold et al. | 102/486 |
| 5,654,523 | A * | 8/1997 | Brunn | 102/498 |
| 7,191,708 | B2 * | 3/2007 | Ouliarin | 102/502 |
| 7,387,073 | B2 * | 6/2008 | Bodley et al. | 102/498 |
| 7,412,929 | B2 * | 8/2008 | Walsh | 102/368 |
| 7,578,895 | B1 * | 8/2009 | Chen et al. | 149/37 |
| 8,025,011 | B1 * | 9/2011 | Yafai et al. | 102/487 |

* cited by examiner

*Primary Examiner* — James Bergin
(74) *Attorney, Agent, or Firm* — Henry S. Goldfine

(57) ABSTRACT

A safer flash-bang grenade that yields the state of the art sound intensity, plus a brighter, more intense flash of the order of 13.5 million candela—which effect is due to a combination of a particularly efficacious pyrotechnic formulation and a particular reaction chamber design that momentarily retains or holds-back the reaction escape until the desired intensity is reached. The particular pyrotechnic formulation is based upon a strontium nitrate oxidizer in conjunction with an aluminum powder metallic fuel and a sulfur non-metallic fuel. The particular reaction chamber design includes a relatively rigid, non-fragmenting charge holder, with a slip-fit thin aluminum sleeve internal thereof and a shrink fit or other sealed sleeve external thereof.

7 Claims, 2 Drawing Sheets
(1 of 2 Drawing Sheet(s) Filed in Color)

FLASH-BANG GRENADE WITH GREATER FLASH INTENSITY

CROSS-REFERENCE TO RELATED APPLICATIONS

This application claims benefit under 35 USC §119(e) of U.S. provisional patent application No. 61/226,033 filed Jul. 16, 2009.

U.S. GOVERNMENT INTEREST

The inventions described herein may be manufactured, used and licensed by or for the U.S. Government for U.S. Government purposes.

FIELD OF THE DISCLOSURE

This disclosure relates generally to stun grenades, and in particular to such a grenade with a significantly enhanced flash effect.

BACKGROUND OF THE DISCLOSURE

Stun grenades have been employed by SWAT teams and by the military for producing a non-lethal explosion to temporarily disorient and/or disable suspects, terrorists, etc. A conventional example of such a stun grenade is given in U.S. Pat. No. 4,947,753, to Nixon et al., issued Aug. 14, 1990, which disclosure is incorporated herein by reference. As disclosed in this patent, such conventional stun grenades standardly include a pull ring assembly and spring-biased striker to ignite a fuse—which pull ring assembly, striker and fuse are located at one end of an elongated body. The fuse creates an ignition spark to ignite or detonate an explosive material located at the other end of the elongated body.

The U.S. Army currently uses a conventional stun or flash-bang grenade, designated the M84, for the purposes detailed above, i.e. to temporarily confuse, disorient, and/or momentarily distract, or incapacitate enemy combatants or terrorists—where such individuals are usually within a confined space, such as a room. The M84 does not supersonically detonate; but, subsonically deflagrates, in a process wherein a pyrotechnic metal-oxidant mix of magnesium and potassium perchlorate charge emits a flash and a loud bang through ports/holes in the cast outer body of the grenade—to produce the desired stun or diversionary effect. Such an effect is critical to minimize collateral damage; especially, in urban warfare, where the presence of noncombatants is likely, or in hostage rescue operations, or to facilitate the capture of enemy combatants.

The M84 delivers a flash in the order of about 1.5 to about 2.5 million candle power and a bang in the order of about 170 to about 180 db within a 5 foot (about 1.5 m) radius. Further, it is critical that the M84 minimize any potential for igniting any common flammable material with which it may come in contact—once again, to minimize collateral damage.

Unfortunately, while the sound level of the M84 and corresponding civilian equivalents (such as the CTS Model 7290 Flash Bang, Combined Tactical Systems, Jamestown, Pa.) is adequate, for maximum effect the brightness or flash level is not high enough. Further, while the M84 has a relatively low potential for the ignition of surrounding flammables, the potential therefore can be further reduced, i.e. made safer.

SUMMARY OF THE DISCLOSURE

The present invention incorporates a very specific pyrotechnic formulation in combination with a very particular reaction chamber design, to momentarily contain or hold back the escape of the reaction, thereby providing a more controlled subsonic deflagrate flash-bang than possible in the prior art, i.e. achieving a higher level of energetic reaction and brighter/more intense flash. The reaction chamber, housed within the body of the flash-bang grenade, has a unique design which incorporates a rigid, non-fragmenting charge holder having a series of vent holes thereabout, and a consumable inner sleeve (i.e. within the charge holder) and a consumable outer sleeve (exterior to the charge holder)—both sleeves being so consumed by the explosive effect of the reaction. This combination of formulation and reaction chamber design provides a critical set of reaction conditions, that produces the desired about 180 db level of sound; but, also produce a surprising increase of up to about 9 times more light than the prior art, i.e. up to a peak light output of as high as 13.5 million candela. Further, as detailed below, in tests of the potential incendiary effect on common materials, using flash-bang grenades of the present invention versus those of the prior art, the present invention flash-bang grenades proved to be safer regarding such incendiary potential (which also indicates increased safety in handling).

The general combination of a nitrate oxidizer, an aluminum metallic fuel and a sulfur non-metallic fuel to form a pyrotechnic is disclosed in U.S. Pat. No. 7,578,895, to Chen et al, issued Aug. 25, 2009 (which is incorporated herein by reference). However, it has been found that one very particular such formulation is useful in the present invention, to yield the desired sound and light emission levels, when in combination with the physical reaction chamber disclosed and claimed herein. This particular preferred formulation contains (in weight percent) from about 50 to about 55%, preferably about 53.5% strontium nitrate oxidizer; about 35 to about 45%, preferably about 40% aluminum powder metallic fuel; about 3 to about 6%, preferably about 5% sulfur non-metallic fuel; and about 0.5% to about 1.5%, preferably about 1% boric acid pH stabilizer; and finally, about 0.5% M5 Cab-o-sil free flow/anti-caking agent, available from Cabot Corporation—Becca Golden, Alpharetta Ga., or equivalent free flow/anti-caking agent. About 8 to about 10 grams, preferably about 9 grams of the strontium nitrate containing formulation are required to provide the desired sound and light properties—when, as stated in combination with the subject reaction chamber. Further, the subject formulation is a dry blended mix—which makes it innately easier to manufacture than conventional wet formulations, which require a granulation and drying of a pyrotechnic mix.

As mentioned above, the particular charge assembly or reaction chamber of the present invention is a composite of a central, relatively ridged and non-fragmenting cylindrical reaction cylinder or charge holder, preferably manufactured of aluminum, most preferably of anodized aluminum, and a consumable inner or internal sleeve and a partially consumable outer or external sleeve. The charge holder has a plurality of groups of longitudinally aligned vent holes about and through its circumference, preferably, six sets of 3 longitudinally aligned vent holes, the sets generally equally spaced about the circumference thereof, and generally centered from the upper and lower ends of the charge holder. The upper end of the charge holder accepts a screwed in plug or fuse adaptor, which on its top or outer face has a conical cavity designed to accept the fuse and provide a path for the fuse spark to reach the pyrotechnic mix held within the charge holder. The lower end of the charge holder is formed by the closed end of the cylindrical container which forms the charge holder.

The reaction chamber composite has a thin internal sleeve, in the order of about 0.002 to about 0.020 inches, nested within the charge holder or cylindrical reaction cylinder—a slip fit—preferably of aluminum, magnesium or a similar metal, or of a nitrocellulose composite. This thin inner sleeve is fully consumed by the explosion that results from the ignition of the pyrophoric material housed in the charge holder—adding to the energy of that explosion. The reaction chamber composite has an outer or external sleeve bonded about its longitudinal length—the outer sleeve can be manufactured of an elastomeric material which is shrink fitted (bonded) about the longitudinal periphery thereof. Other preferred embodiments of the outer sleeve include non-shrink fit, rigid, elastomeric materials or thin aluminum. The portions of the outer sleeve exposed to the reaction through the vents in the charge holder are consumed by the reaction—just as the inner sleeve is consumed.

Further, considering that the reaction chamber is exposed to the elements through the sound/light ports in the overall stun grenade's housing (or body), the external sleeve must provide a waterproof enclosure to protect the pyrotechnic mix held therein.

Further features and advantages of the present invention will be set forth in, or apparent from, the figures and detailed description of preferred embodiments thereof which follows.

BRIEF DESCRIPTION OF THE DRAWINGS

A more complete understanding of the present disclosure may be realized by reference to the accompanying drawings, at least one of which drawings is executed in color. Copies of this patent or application file, with said color drawing(s), will be provided by the Office upon request and payment of the necessary fee. The drawings themselves are not necessarily to scale and like parts have been given like numbers. The drawings encompass the following figures.

DETAILED DESCRIPTION

As detailed above, to achieve the desired brightness, i.e. intensity of flash, the particular charge assembly or reaction chamber of the present invention is a composite of a central, relatively ridged and non-fragmenting cylindrical reaction cylinder or charge holder. Considering the pressure forces generated by the pyrotechnic mix that is reacted therein, one would consider a first explosive pressure effect along the long, longitudinal, axis of the charge holder, which generates longitudinal stress, $\sigma_l$, along that axis—in the direction of the respective ends of the cylindrical reaction vessel. Further, to complete the stress analysis, one would also consider a second explosive pressure effect against the cylindrical walls, perpendicular to the longitudinal axis effect—what is known as the hoop direction and the hoop stress, $\sigma_h$. Applying Newton's first law of motion, one can easily derive for both the longitudinal stress and the hoop stress the following equations:

$$\sigma_l = pr/2t; \quad (1)$$

$$\sigma_h = pr/t \quad (2)$$

where: p=internal gage pressure; r=radius of the cylinder; and t=the wall thickness of the subject pressure vessel.

Clearly from Equations 1 and 2, above, the hoop stress is twice that of the longitudinal stress—which is generally why an overcooked generally cylindrical hotdog usually cracks along the longitudinal direction (the skin thereof failing due to internal steam causing hoop pressure).

Figure 1:
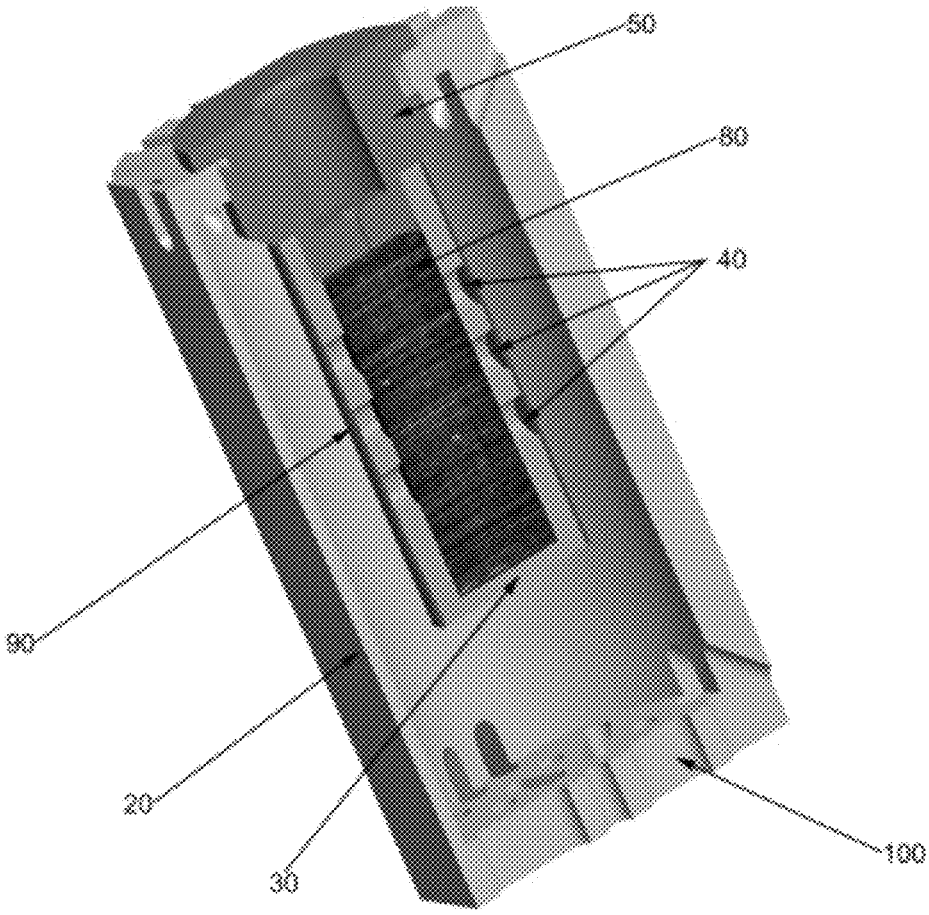
FIG. 1 is a cross-sectional detail of a stun or flash-bang grenade of the preferred embodiment of the present invention.
Figure 2:
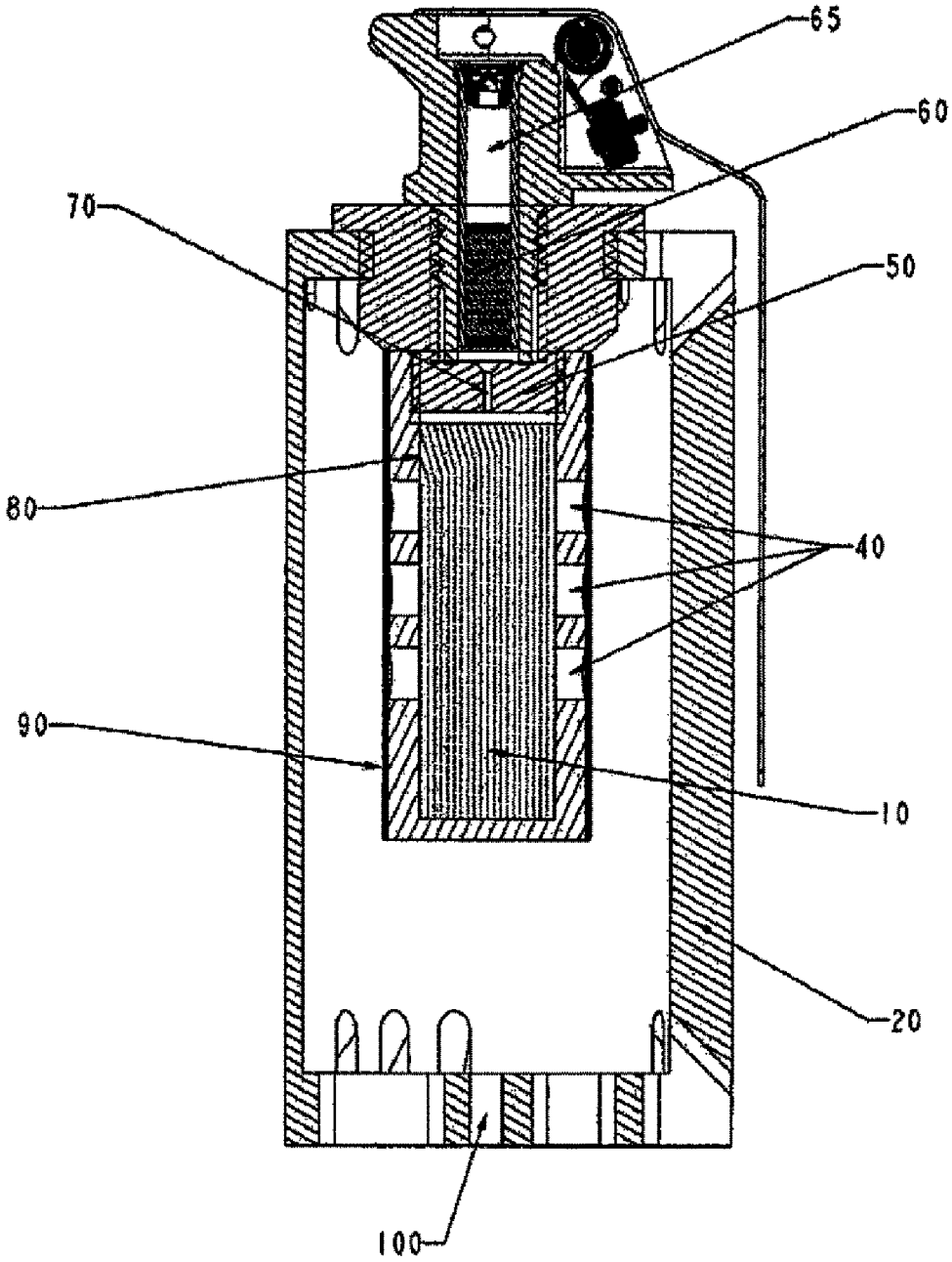
FIG. 2 is a partial perspective cross-sectional perspective view of the body or housing of a preferred embodiment of the present invention, showing therein the composite charge assembly or reaction chamber of the present invention.

Referring to FIG. 1, a stun or flash-bang grenade, 10, of the present design and to FIG. 2, which is a partial view thereof, focusing on the composite charge assembly or reaction chamber. Understanding the above equations regarding the internal forces that the pyrotechnic mix, 110, generates upon reaction—it is clear that the hoop stress is twice as great as the longitudinal stress. Therefore it would be expected that the explosive force would exit the composite reaction chamber through the vent holes, 40, and this has proven to be the case. In the process, as detailed above, the inner sleeve, 30, is consumed by the reaction of the pyrotechnic mix and the portions or parts of the outer sleeve, 90, covering the vent holes, 40, are also consumed. The delay or "hold back" of the escape of the particular reaction from the composite reaction chamber, due to the initial presence of the inner, 80, and outer, 90, sleeves, results in the high level of sound and intensity of light which escapes from the sound/light ports, 100, in the body or housing, 20, i.e. about 180 db (measured at 5 feet) and up to 13.5 million candela, respectively.

Continuing to refer to FIG. 1, one will observe that the subject flash-bang grenade, 10, utilizes a convention stun grenade arrangement of a fuse, 65, and fuse delay mix, 60, which is aligned within the fuse adaptor, 50, to provide a spark along a spark path, 70, to ignite the pyrotechnic mix, 110. Not detailed in FIG. 1 is the conventional pull ring assembly and spring-biased striker used to ignite the fuse.

As detailed above, the charge holder, 30, is preferably of anodized aluminum at least 1/10 inch in thickness, to provide a relatively rigid, non-fragmenting reaction cylinder. The charge holder, 30, and has a plurality of groups of longitudinally aligned holes, 40, about its periphery, preferably, six sets of 3 longitudinally aligned vent holes, the sets equally spaced about the periphery and centered from the upper and lower ends of the charge holder. Preferably, the cylindrical charge holder, 30, is about 2¼ to about 2⅜ inches in overall length, with an internal effective charge holding length of about 1⅞ inches, and has an effective internal charge holding diameter of about ⅝ inch and an overall external diameter of about 1 inch—such that the charge holding capacity of the charge holder is effectively about 0.58 cubic inches. The charge holder, 30, preferably has 6 rows of 3 vent holes, 40, therethrough—with each vent hole, 40, being preferably about ¼ inch in diameter and spaced about ⅛ inch apart (in each the row of 3). The upper end of the charge holder, 30, accepts a screwed in plug or fuse adaptor, 50, which on its top face has a conical cavity designed to accept the fuse assembly, 65, which may contain a separate fuse delay timing mix, 60, and which may provide a path, 70, for the fuse spark to reach the pyrotechnic mix held within the charge holder. The lower end of the charge holder, 30, is formed by the closed end of the cylindrical container which forms the charge holder.

As also stated above, the reaction chamber composite has a thin internal or inner sleeve, 80, in the order of about 0.002 to about 0.020 inches thick, preferably from about 0.004 to about 0.009 inches thick, and most preferably from about 0.005 to about 0.006 inches thick—which inner sleeve, 80, is nested within the charge holder, 30, a slip fit. Preferably the inner sleeve, 80, is manufactured of aluminum, magnesium or a similar metal, or of a nitrocellulose composite. This thin inner sleeve, 80, is fully consumed by the explosion that results from the ignition of the pyrophoric material housed in the charge holder—adding to the energy of that explosion.

The reaction chamber composite has an outer or external sleeve, 90, bonded to form a tight sealed along its longitudinal length—the outer sleeve, 90, can be preferably be manufactured of heat shrink tubing (which can be applied by simply placing the external sleeve, 90, material over the charge holder, 30, and placing the assembly in a 275 degree F. oven for about 20 minutes); a heat shrink tubing with an adhesive lining (e.g. Thomas and Betts HS series, Thomas and Betts Corp., Memphis, Tenn.); heat shrink tubing with thermoset material underneath an elastomeric material, which is shrink fitted about the longitudinal periphery thereof; or, it can be manufactured of a thin aluminum cup/sleeve secured with epoxy (about the same thickness, 0.002 to about 0.020 inches, as the inner sleeve, 80), or a plastic sleeve secured with epoxy, or plastic secured with epoxy or hot melt adhesive. As stated above, the portions of the outer sleeve exposed to the reaction through the vents in the charge holder are consumed by the reaction—just as the inner sleeve is consumed.

As also stated above, this is one very particularly preferred pyrotechnic formulation mix, which is capable of yielding the desired sound and light emission levels in combination with the physical reaction chamber disclosed and claimed herein. This particular preferred formulation contains, in weight percent, about 50 to about 55%, preferably about 53.5% strontium nitrate oxidizer; about 35 to about 45%, preferably about 40% aluminum powder metallic fuel; about 3 to about 6%, preferably about 5% sulfur non-metallic fuel; and about 0.5% to about 1.5%, preferably about 1% boric acid pH stabilizer; and finally, about 0.5% of a free flow/anti-caking agent, such as, M5 Cab-o-sil free flow/anti-caking agent, available from Cabot Corporation—Becca Golden, Alpharetta Ga. About 8 to about 10 grams, preferably about 9 grams of this strontium nitrate containing formulation are required to provide the desired sound and light properties. Considering the density of this formulation, to accommodate the 8 to 10 gram quantity required, the cylindrical chamber formed by the inner sleeve, 80, would be about ⅝ inches in diameter by about 1⅞ inches long.

Example I

Determination of Sound & Flash Intensity

A series of repetitive performance tests were conducted with the subject invention, the results of which are detailed in Table I, immediately below. The preferred embodiment of the present invention used in the series of tests included a charge of 9 grams of a pyrotechnic mix of about 53.7 wt. % strontium nitrate oxidizer; about 40 wt. % aluminum powder metallic fuel; about 5 wt. % sulfur non-metallic fuel; about 1 wt. % boric acid pH stabilizer; and finally, about 0.3 wt. % M5 Cab-o-sil free flow/anti-caking agent and a reaction chamber of the subject design. The particular preferred reaction chamber used in the tests had a 0.005 inch aluminum inner sleeve, 80, an aluminum charge holder, 30, with 6 sets of equally spaced, about the circumference, groups of 3 longitudinally aligned venting holes, 40, and an outer or external sleeve, 90, of Thomas and Betts HS tubing, particularly HS4-30LR Shrink-Kon® Tubing, which is a heavy-wall heat-shrinkable tubing for cable Range 1-3/0 AWG, a cross-linked polyolefin with thermoplastic adhesive liner.

TABLE I

| Performance Data | | |
|---|---|---|
| Sample | Sound Intensity @ 5 feet (Peak level in db) | Light Intensity (Peak MCd) |
| 1 | 179.9 | 11.8 |
| 2 | 179.7 | 12.6 |
| 3 | 180.0 | 13.5 |
| 4 | 179.6 | 10.9 |
| 5 | 179.9 | 13.3 |

Example II

Determination of Safety Re: Incendiary Effect

A series of incendiary tests were conducted using the current M84 stun grenade and a flash-bang grenade of the present invention, as detailed in Example I, above. The tests comprised detonating a series of such stun/flash-bang grenades directly on paper, cotton, and standard Army Combat Uniform material. While in the case of both the current M84 and flash-hang grenades, none of the various materials were ignited—with the M84 the cotton smoldered, repeatably—an effect which was not observed with the flash-bang grenades of the present invention. Therefore the subject inventive flash-bang grenade proved safer in use (not only to materials regarding which the grenade may contact upon use—but, also to the user, in the event of an accident or to anyone in the immediate vicinity upon detonation) vs. the current, prior art, M84 stun/flash-bang grenade.

At this point, while we have discussed and described the invention using some specific examples, those skilled in the art will recognize that our teachings are not so limited. Accordingly, the invention should be only limited by the scope of the claims attached hereto.

The invention claimed is:

1. A safer and brighter flash-bang grenade, comprising:

a pyrotechnic mix of about 50 to about 55 wt. % strontium nitrate, about 35 to about 45 wt. % aluminum powder, about 3 to 6 wt. % sulfur, about 0.5 to about 1.5 wt. % boric acid, and about 0.5% anti-caking agent;

the pyrotechnic mix being held in a reaction chamber composite housed within the body of the flash-bang grenade, which body has a series of light/sound venting ports;

the reaction chamber composite being formed of an inner sleeve of aluminum with a thickness of from about 0.002 to about 0.020 inches, an aluminum charge holder with a thickness of at least about 1/10 inch slip fit about the inner sleeve, and an outer sleeve bonded about the charge holder;

the aluminum charge holder having a plurality of vent holes through and about its circumference;

wherein, upon ignition, the flash-bang grenade will emit a peak sound level of about 180 db measured at 5 feet therefrom and emit a peak light intensity of about 13.5 million candela.

2. The safer and brighter flash-bang grenade of claim 1, wherein the quantity of pyrotechnic mix is from about 8 to about 10 grams.

3. The safer and brighter flash-bang grenade of claim 1, wherein the pyrotechnic mix is about 53.7 wt. % strontium nitrate oxidizer; about 40 wt. % aluminum powder metallic fuel; about 5 wt. % sulfur non-metallic fuel; about 1 wt. % boric acid pH stabilizer; and about 0.3 wt. % free flow/anti-caking agent.

4. The safer and brighter flash-bang grenade of claim 1, wherein the inner sleeve has a thickness of from about 0.005 to about 0.006 inches thick.

5. The safer and brighter flash-bang grenade of claim 1, wherein the outer sleeve is selected from the group consisting of heat shrink tubing, a heat shrink tubing with an adhesive lining; heat shrink tubing with thermoset material underneath an elastomeric material, a thin aluminum cup/sleeve secured with epoxy, a plastic sleeve secured with epoxy, and a plastic sleeve hot melt adhesive.

6. The safer and brighter flash-bang grenade of claim 1, wherein aluminum charge holder has 6 sets of vent holes equally spaced about and through the circumference thereof, vent holes being in groups of 3, each group being aligned with the longitudinal axis of the charge holder.

7. The safer and brighter flash-bang grenade of claim 1, wherein the flash-bang grenade when detonated on cotton will not cause the cotton to smolder.

* * * * *